US010199759B2

(12) United States Patent
Raettich et al.

(10) Patent No.: US 10,199,759 B2
(45) Date of Patent: Feb. 5, 2019

(54) TOUCH-PROTECTED SOCKET, PLUG, AND PLUG-IN CONNECTION

(71) Applicant: Bayerische Motoren Werke Aktiengesellschaft, Munich (DE)

(72) Inventors: Philip Raettich, Munich (DE); Matthias Wagner, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 15/701,571

(22) Filed: Sep. 12, 2017

(65) Prior Publication Data

US 2017/0373421 A1 Dec. 28, 2017

Related U.S. Application Data

(63) Continuation of application No. PCT/EP2016/058832, filed on Apr. 21, 2016.

(30) Foreign Application Priority Data

Jun. 8, 2015 (DE) ..... 10 2015 210 410

(51) Int. Cl.

| | |
|---|---|
| ***H01R 4/48*** | (2006.01) |
| ***H01R 13/187*** | (2006.01) |
| ***H01R 13/193*** | (2006.01) |
| ***H01R 13/631*** | (2006.01) |
| ***H01R 13/639*** | (2006.01) |

(52) U.S. Cl.

CPC ..... *H01R 13/187* (2013.01); *H01R 4/4809* (2013.01); *H01R 13/193* (2013.01); *H01R 13/631* (2013.01); *H01R 13/639* (2013.01)

(58) Field of Classification Search

CPC .. H01R 4/4845; H01R 4/4836; H01R 4/4827; H01R 13/193; H01R 13/113; H01R 13/04

USPC ..... 439/835, 838, 839

See application file for complete search history.

(56) References Cited

U.S. PATENT DOCUMENTS

| | | | |
|---|---|---|---|
| 3,958,851 | A | 5/1976 | Evans |
| 4,768,981 | A | 9/1988 | Hohorst |

(Continued)

FOREIGN PATENT DOCUMENTS

| | | | |
|---|---|---|---|
| AT | 386 298 | B | 7/1955 |
| CN | 102195176 | A | 9/2011 |

(Continued)

OTHER PUBLICATIONS

International Search Report (PCT/ISA/210) issued in PCT Application No. PCT/EP2016/058832 dated Jul. 18, 2016 with English translation (Six (6) pages).

(Continued)

*Primary Examiner* — Hien Vu

(74) *Attorney, Agent, or Firm* — Crowell & Moring LLP

(57) ABSTRACT

A socket has a housing, which is composed of an electrically insulating material and an elongate plug-receiving region. A contact spring is arranged in the plug-receiving region. A lever loads the contact spring in the open position of the lever such that a dimension of the contact spring transverse to the longitudinal direction of the plug-receiving region is reduced and relaxes the contact spring in the closed position of the lever. A plug is provided for such a socket.

12 Claims, 2 Drawing Sheets

(56) References Cited

U.S. PATENT DOCUMENTS

| | | | | |
|---|---|---|---|---|
| 6,004,168 | A * | 12/1999 | Fuchs | H01R 4/4845 439/630 |
| 6,261,120 | B1 * | 7/2001 | Beege | H01R 4/4836 439/268 |
| 6,712,649 | B2 * | 3/2004 | Mano | H01R 4/4845 439/441 |
| 8,062,077 | B2 * | 11/2011 | Hayashi | H01R 9/2408 439/725 |
| 8,262,422 | B1 | 9/2012 | Chiang | |
| 2016/0006176 | A1 | 1/2016 | Kollmann et al. | |
| 2016/0049737 | A1 | 2/2016 | Aporius et al. | |

FOREIGN PATENT DOCUMENTS

| | | | |
|---|---|---|---|
| CN | 103918139 | A | 7/2014 |
| CN | 104638426 | A | 5/2015 |
| DE | 25 57 598 | A1 | 7/1976 |
| DE | 10 2013 101 406 | A1 | 8/2014 |
| DE | 20 2013 101 582 | U1 | 8/2014 |
| EP | 0 345 788 | A2 | 12/1989 |
| EP | 1 081 790 | A2 | 3/2001 |
| EP | 2 287 976 | A1 | 2/2011 |
| JP | 7-99076 | A | 4/1995 |
| JP | 2014-216305 | A | 11/2014 |
| TW | 201212407 | A1 | 3/2012 |

OTHER PUBLICATIONS

German-language Written Opinion (PCT/ISA/237) issued in PCT Application No. PCT/EP2016/058832 dated Jul. 18, 2016 (Six (6) pages).

German-language Office Action issued in counterpart German Application No. 10 2015 210 410.9 dated Feb. 3, 2016 (Six (6) pages).

Chinese Office Action issued in Chinese counterpart application No. 201680009863.2 dated Aug. 3, 2018, with English translation (Thirteen (13) pages).

* cited by examiner

TOUCH-PROTECTED SOCKET, PLUG, AND PLUG-IN CONNECTION

CROSS REFERENCE TO RELATED APPLICATIONS

This application is a continuation of PCT International Application No. PCT/EP2016/058832, filed Apr. 21, 2016, which claims priority under 35 U.S.C. § 119 from German Patent Application No. 10 2015 210 410.9, filed Jun. 8, 2015, the entire disclosures of which are herein expressly incorporated by reference.

BACKGROUND AND SUMMARY OF THE INVENTION

The invention relates to a touch-protected socket, a plug and a plug-in connection, in which electrical contact is established between the socket and the plug in the interior of the socket, which socket has a housing produced from an electrically insulating material.

AT 386 298 B discloses a connecting terminal for electrical conductors in which electrical contact is established between two electrical conductors within an electrically insulating housing, wherein a clamping spring prevents the electrical conductors from being pulled out. A trigger can be used to move the clamping spring to a tensioned state in which the electrical conductors can be inserted into the connecting terminal and to a state in which it is relieved of tension and the electrical conductors are prevented from being pulled out of the connecting terminal.

However, the existing prior art with respect to plug-in connections requires improvements in relation to simple operator control and assembly.

An object of the present invention is to provide a plug-in connection which is, first of all, touch-protected and, secondly, simple to control. This object is achieved by a socket, a plug, and a plug-in connection in accordance with embodiments of its invention.

According to one exemplary embodiment of the invention, a socket is provided. The socket comprises a housing which is composed of electrically insulating material and has an elongate plug-receiving region. A contact spring is arranged in the plug-receiving region. And, a lever in its open position, tensions the contact spring, so that a dimension of the contact spring transverse to the longitudinal direction of the plug-receiving region is reduced, and in its closed position, relieves the contact spring of tension relative to the tensioned state. That is to say, in the closed position of the lever, the contact spring has a lower pretension (for example a slight pretension or a state in which it is completely relieved of tension) than in the open position of the lever.

According to this exemplary embodiment, a contact connection can be established between the socket and the plug on the inner side of the components, wherein the outer sides are designed to be electrically insulating. This ensures touch-protection not only in the plug-connected state but also in the non-plug-connected state. Owing to the lever and its interaction with the contact spring, a force which has to be applied for the plug-in process is minimized and, nevertheless, a good contact force between the plug-connected components is ensured. The plug-in forces are furthermore independent of the normal contact force which can be achieved, so that high resulting normal contact forces can be achieved with a low operator control force.

According to a further exemplary embodiment of the invention, the socket is designed such that the lever, in the closed state, extends into an inlet opening in the plug-receiving region. Therefore, a plug in the plug-receiving region is prevented from being pulled out.

According to a further exemplary embodiment of the invention, the contact spring is fixedly connected to an electrically conductive connection to which an electrical line can be connected.

According to a further exemplary embodiment of the invention, the socket is designed such that the lever can be pivoted about a rotation axis and has a grip region, wherein an operating end of the lever, which operating end is situated on the opposite side to the grip region with respect to the rotation axis, tensions the contact spring.

According to a further exemplary embodiment of the invention, the contact spring comprises a component or structural element which is both resilient and electrically conductive.

According to a further exemplary embodiment, the contact spring is a bent leaf spring which has two ends which both point toward the same longitudinal end of the socket.

According to a further exemplary embodiment, the contact spring comprises one component which is resilient, and comprises another component which is electrically conductive. For example, a helical spring could form the resilient component and a structural element which is pretensioned by the helical spring could form the electrically conductive component. It is likewise possible for a non-conductive resilient material (for example an elastomer) to form the resilient component and for a material which is pretensioned by the non-conductive resilient material to form the electrically conductive component.

The invention furthermore provides a plug for a socket, wherein the plug has an electrically insulating housing and a clearance into which the contact spring of the socket can be inserted when the plug is inserted into the socket. Therefore, touch-protection is provided for all structural elements (plug and socket) in all situations which occur during operation and during assembly.

The invention further provides a plug-in connection having a socket according to one of the exemplary embodiments and a plug of this kind, wherein the contact spring is dimensioned such that, when the lever is open and as a result the contact spring is tensioned, the contact spring can be inserted into the clearance in the plug, and, when the lever is closed, the contact spring presses against an electrically conductive inner face of the clearance. In the process, the electrically conductive inner face of the clearance can be formed by sections of the housing, which are designed to be conductive in sections, or separate structural elements which are fixedly connected to the housing.

According to a further exemplary embodiment of the invention, the socket is designed such that, when the lever is closed, the lever engages behind the plug which is inserted into the plug-receiving region, so that the plug is prevented from being pulled out of the socket.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
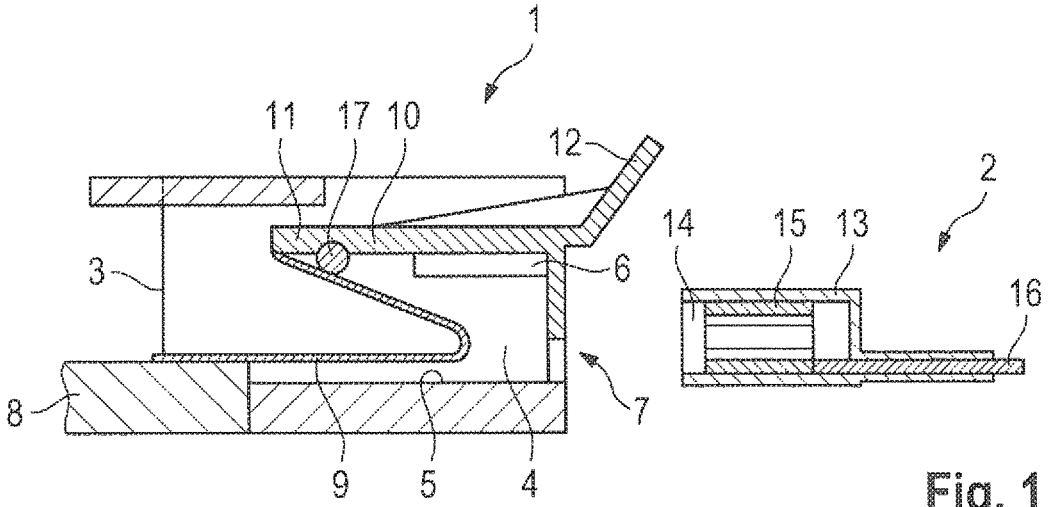
FIG. 1 shows the plug-in connection according to an embodiment of the invention wherein a socket and a plug are illustrated in section.
Figure 2:
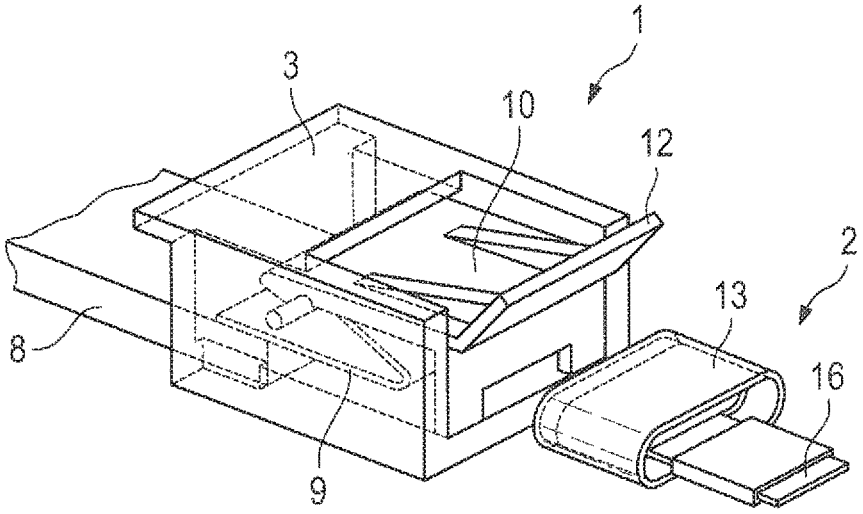
FIG. 2 shows a three-dimensional illustration of the plug-in connection from FIG. 1.

FIG. 1 shows a plug-in connection according to a preferred exemplary embodiment of the present invention, comprising a socket 1 and a plug 2 which are both illustrated as a sectional illustration in FIG. 1. FIG. 2 shows this plug-in connection in a three-dimensional view. A housing 3 of the socket 1 is substantially cuboidal. However, the invention is not restricted to a specific housing shape, and therefore the housing 3 can also have any suitable shape. A plug-receiving region 4 which is adapted to receive the plug 2 is formed in the socket 1, that is to say in the housing 3 of the socket 1. The plug-receiving region 4 is delimited firstly by a housing inner face 5 and secondly by a web 6 which runs parallel to the housing inner face 5. The housing inner face 5 and a face of the web 6 are situated opposite one another. Furthermore, the plug-receiving region 4 can be defined by two inner faces of the housing 3 which run perpendicular to these boundary faces. This plug-receiving region 4 is elongate, wherein a longitudinal direction of the plug-receiving region 4 corresponds to an insertion direction of the plug 2. The plug-receiving region 4 can also be formed by other faces and/or means.

In this case, it is essential that a receiving region is created within the socket 1, it being possible for a plug 2 to be plugged into said socket. The dimensioning of the plug-receiving region 4 is matched to the dimensions and the contour of the plug 2, so that the plug can be plugged in and held in the plugged-in state as far as possible without play. Furthermore, the plug-receiving region 4 has an inlet opening 7 through which the plug 2 is pushed into the plug-receiving region 4. In this case, the inlet opening 7 is intended to constitute an interruption in an outer contour of the housing 3.

The socket 1 is provided with an electrically conductive connection 8 opposite to the inlet opening 7. The electrical connection 8 can be, for example, a pole connection of an electrical energy store, for example of an energy store for a motor vehicle. However, the connection 8 can also be in the form of a socket for a pole connection of an electrical energy store, into which connection a pole connection can be plugged.

Furthermore, the connection 8 can serve to connect an electrical conductor to the socket. It is possible for the electrical conductor to be, for example, an electrical cable (having one or more wires) or an electrical wire with a solid or flexible conductor. This electrical line can be connected to the connection 8 by clamping, pinching, soldering or the like.

Furthermore, a contact spring 9 is provided in the socket 1. The contact spring is in the form of a bent leaf spring for example. The contact spring 9 is formed from an electrically conductive material and is in particular of integral, in particular monolithic, design. In the present exemplary embodiment, the contact spring 9 has two rectilinear limbs and an arc section which connects these limbs. The two rectilinear limbs form an angle which is, for example, less than 45°. One of the rectilinear limbs is electrically conductively, in particular fixedly, connected to the connection 8, specifically to its end which is remote from the arc section of the contact spring 9. The other rectilinear limb, at its end which is remote from the arc section, is in loose contact with a lever 10, in particular with an operating end 11 of the lever 10, specifically at least in operating states in which the plug 2 is not plugged into the socket 1.

The contact spring 9 is positioned such that it is partially, in particular for the most part, arranged within the plug-receiving region 4, wherein the arc section extends to the inlet opening in the plug-receiving region 4. In this case, the contact spring 9 is positioned such that an intermediate space is formed between the contact spring 9, in particular its arc section, and the inlet opening 7 within the plug-receiving region 4. In this case, the intermediate space is so large that a user cannot unintentionally touch the contact spring 9 with a finger. That is to say, the contact spring 9 is recessed in the plug-receiving region 4 in order to prevent contact with the contact spring, which is live during operation, in all operating states. The geometry of the plug-in connection can also be selected such that higher touch-protection classes can be achieved.

The lever 10 is substantially L-shaped, wherein one limb runs parallel to the longitudinal direction of the plug-receiving region 4 and the other limb is perpendicular thereto, so that it partially covers the inlet opening 7 in the plug-receiving region 4 in the closed state. In addition, a grip region 12 is provided on the lever 10, it being possible for the lever 10 to be operated by a fitter or user by way of said grip region. The housing 3 of the socket 1, and the lever 10, together with the grip 12, are produced from an electrically insulating material, in particular plastic. The lever 10 is connected to the housing 3, such that it can rotate about a rotation axis 17, adjacent to the operating end 11.

The plug 2 has an electrically insulating housing 13, for example composed of plastic, which is dimensioned such that it fits into the plug-receiving region 4 without play. A clearance 14 is provided in the interior of the housing 13, said clearance being open on one side. An annular contact ring 15 is provided in the clearance 14. The contact ring surrounds the clearance 14 in the manner of a ring, that is to say running on the inner wall of the clearance 14, and an electrical conductor 16 is electrically conductively connected to the contact ring 15. This electrical conductor 16 is, for example, an electrical cable (comprising one or more wires) or an electrical wire with a solid or flexible conductor. The contact ring 15 forms, as a separate structural element which is fixedly connected to the housing 13, a conductive inner face of the clearance 14. It is likewise contemplated for a conductive material, instead of the contact ring 15, to be applied to, for example vapor-deposited on, the inner face of the clearance 14, or for the housing 13 to be formed by another, conductive material only on the inner side of the clearance 14.

The use of the plug-in connection according to the invention will be described in the text which follows with reference to FIGS. 3A to 3D. Here, FIG. 3A initially illustrates a state in which the socket 1 is closed, that is to say the lever 10 of the socket 1 is in a closed position. Furthermore, the plug 2 is not plugged into the socket 1 in this state from FIG. 3A. If the plug 2 is to be plugged into the socket 1 and electrical contact is to be established between the contact ring 15 and the contact spring 9 of the socket 1, this in turn establishing contact between the electrical conductor 16 and the electrical conductor which is connected to the connection 8, the following procedure is then followed. The lever 10 is first raised by way of its grip region 12 and rotated about its rotation axis 17. The lever 10 then opens the inlet opening 7 and the operating end 11 of the lever 10 pushes that limb of the contact spring 9 bearing against it in the direction of the other limb of the contact spring 9, as a result of which the contact spring 9 is tensioned and its dimension transverse to the longitudinal direction of the plug-receiving region 4 is reduced in comparison to the previous state.

Figure 3A:
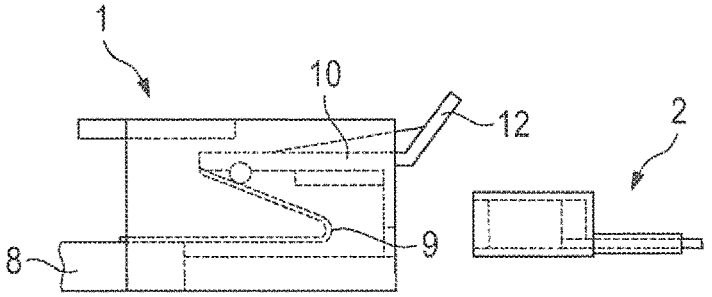
FIG. 3A shows the plug-in connection from FIG. 1 in a state in which a lever of the socket is closed and a plug of the plug-in connection is not plugged into the socket.
Figure 3B:
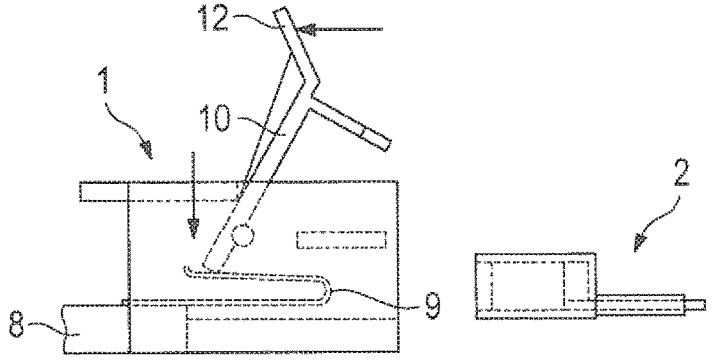
FIG. 3B shows the plug-in connection from FIG. 1 in a state in which a lever of the socket is open and the plug of the plug-in connection is not plugged into the socket.
Figure 3C:
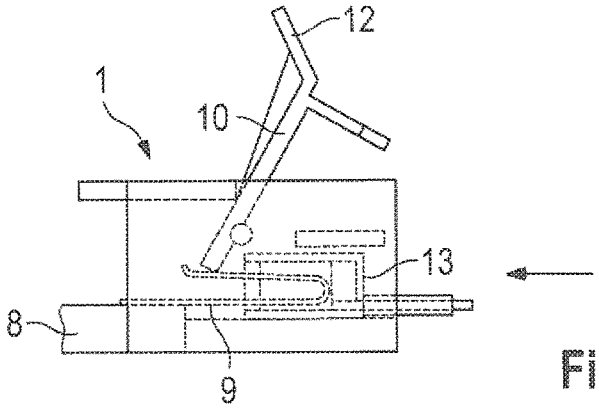
FIG. 3C shows the plug-in connection in a state in which the lever of the socket is open and the plug of the plug-in connection is inserted into the socket.

As illustrated in FIG. 3C, the plug 2 can then be pushed into the plug-receiving region 4 through the inlet opening 7. Owing to the tensioned contact spring 9, the contact spring can be pushed into the clearance 14 and, in particular, into the interior of the contact ring 15 with little force. In this case, the dimensions of the clearance 14, of the contact ring 15 and of the contact spring 9 are to be set such that sufficiently good electrical contact is established between contact spring 9 and contact ring 15.

Figure 3D:
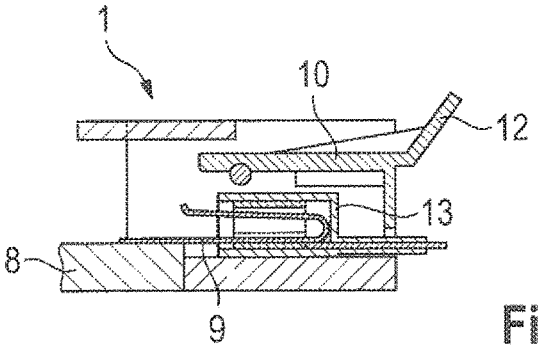
FIG. 3D shows the plug-in connection from FIG. 1 in a state in which the lever of the socket is closed and the plug of the plug-in connection is inserted into the socket.

After the plug 2 has been inserted into the plug-receiving region 4, the lever 10 can once again be rotated back into its starting position from FIG. 3A in which one limb of the plug 10 at least partially covers the inlet opening 7. This state is illustrated in FIG. 3D. As shown, the arc section and limb sections of the contact spring 9 which are adjacent to said arc section are now located in the interior of the contact ring 15, wherein good electrical contact is established between contact spring 9 and contact ring 15 by the restoring force of the contact spring 9. The contact area between the structural elements which are in contact can be changed, for example considerably increased, by way of adapting the contact spring 9, that is to say its shape and/or spring force. In this state, the operating end 11 of the lever 10 is no longer in contact with the contact spring 9. The plug 2 is prevented from being pulled out of the socket 1 by the inlet opening 7 being partially covered by the lever 10.

The contact spring 9 has been described as a leaf spring above. However, the contact spring can also be of different design. For example, the contact spring can have a resilient component (for example a helical spring) which is supported, for example, on the housing side opposite the lever 10 and pretensions an electrically conductive component in the direction of the lever 10, which electrically conductive component establishes the contact between the contact ring 15 and the connection 8.

While the invention has been illustrated and described in detail in the drawings and the preceding description, this illustration and description is intended to be understood to be illustrative or exemplary and not to be limiting and it is not intended to limit the invention to the exemplary embodiments disclosed. The simple fact that specific features are mentioned in different dependent claims is not intended to indicate that a combination of those features could not also be used in an advantageous manner.

What is claimed is:

1. A plug-in connection, comprising:

a socket including:

a housing which is composed of electrically insulating material and has an elongate plug-receiving region;

a contact spring which is arranged in the plug-receiving region; and a lever which, in an open position, tensions the contact spring, so that a dimension of the contact spring transverse to a longitudinal direction of the plug-receiving region is reduced, and which, in a closed position, relieves the contact spring of tension relative to the tensioned state, and a plug having an electrically insulated housing and a clearance into which the contact spring of the socket is insertable when the plug is inserted into the socket, and wherein the contact spring is dimensioned such that, when the lever is in the open position and as a result the contact spring is tensioned, the contact spring is insertable into the clearance in the plug, and, when the lever is in the closed position, the contact spring presses against an electrically conductive inner face of the clearance of the plug.

2. The plug-in connection as claimed in claim 1, wherein when the lever is in the closed position, the lever engages behind the plug that is inserted into the plug-receiving region, so that said plug is prevented from being pulled-out of the socket.

3. The plug-in connection as claimed in claim 1, wherein the lever, in the closed position, extends into an inlet opening in the plug-receiving region.

4. The plug-in connection as claimed in claim 3, wherein the contact spring is fixedly connected to an electrically conductive connection to which an electrical line is connectable.

5. The plug-in connection as claimed in claim 1, wherein the contact spring is fixedly connected to an electrically conductive connection to which an electrical line is connectable.

6. The plug-in connection as claimed in claim 1, wherein the lever is pivotable about a rotation axis and has a grip region, and an operating end of the lever, which operating end is situated on an opposite side to the grip region with respect to the rotation axis, tensions the contact spring.

7. The plug-in connection as claimed in claim 1, wherein the contact spring comprises a component which is both resilient and electrically conductive.

8. The plug-in connection as claimed in claim 7, wherein the contact spring is a bent leaf spring which has two ends which both point toward a same longitudinal end of the socket.

9. The plug-in connection as claimed in claim 6, wherein the contact spring is a bent leaf spring which has two ends which both point toward a same longitudinal end of the socket.

10. The plug-in connection as claimed in claim 1, wherein the contact spring is a bent leaf spring which has two ends which both point toward a same longitudinal end of the socket.

11. The plug-in connection as claimed in claim 1, wherein the contact spring comprises one component which is resilient, and comprises another component which is electrically conductive.

12. The plug-in connection as claimed in claim 6, wherein the contact spring comprises one component which is resilient, and comprises another component winch is electrically conductive.

* * * * *